United States Patent [19]

Porter et al.

[11] 3,932,070

[45] Jan. 13, 1976

[54] ELECTRIC MOTOR FAN UNIT FOR WET WORKING AIR

[75] Inventors: John H. Porter, Talmadge; Robert O. Swift, Stow, both of Ohio

[73] Assignee: Ametek, Inc., New York, N.Y.

[22] Filed: Feb. 26, 1974

[21] Appl. No.: 445,989

[52] U.S. Cl. ..... 417/423 A; 415/180; 417/368

[51] Int. Cl.[2] ..... F04B 17/00

[58] Field of Search.... 417/423 A, 424, 368, 423 R; 415/180, 170 A

[56] References Cited

UNITED STATES PATENTS

| | | | |
|---|---|---|---|
| 2,172,135 | 9/1939 | Breuer | 417/423 A |
| 2,470,563 | 5/1949 | Jennings | 417/424 |
| 2,822,122 | 2/1958 | Cole | 417/423 A |
| 3,071,075 | 1/1963 | Spring | 417/423 R |
| 3,245,610 | 4/1966 | Sebok et al. | 417/423 A |
| 3,733,150 | 5/1973 | Porter et al. | 417/424 |
| 3,790,312 | 2/1974 | Bottoms | 417/424 |

FOREIGN PATENTS OR APPLICATIONS

| | | | |
|---|---|---|---|
| 465,624 | 6/1950 | Canada | 417/423 A |
| 591,835 | 9/1948 | United Kingdom | 417/423 R |

*Primary Examiner*—C. J. Husar
*Assistant Examiner*—O. T. Sessions
*Attorney, Agent, or Firm*—P. D. Golrick

[57] ABSTRACT

In an electric motor fan unit, a motor section frame enclosing a motor ventilating fan moving air through an internal motor cooling air path includes an end bracket with an enlarged rim for mounting fan shell and interior partition structures defining a fan section housing with a chamber for a working air centrifugal impeller mounted on the motor shaft outboard of the end bracket and drawing a working air stream into a housing axial inlet for discharge at the housing circumference, and with an inner chamber for a slinger disk on the shaft to afford bearing protection from working air borne moisture, contaminants, and high temperature and humidity, by simple, low cost, durable structure.

14 Claims, 3 Drawing Figures

INVENTORS
JOHN H. PORTER,
& ROBERT O. SWIFT
BY
ELY, GOLRICK & FLYNN
ATTORNEYS

INVENTORS
JOHN H. PORTER,
& ROBERT O. SWIFT
BY
ELY, GOLRICK & FLYNN
ATTORNEYS

ELECTRIC MOTOR FAN UNIT FOR WET WORKING AIR

Though discussion and description here is presented in terms of vacuum cleaner motor-fan units, it is to be understood that described inventive features may find use in other applications of the motor fan unit.

In modern vacuum cleaners of various types, commonly the fan system for pumping or moving the vacuum cleaning air stream, the so-called "working air", and the electric motor therefor, generally a commutating series universal type motor, are fabricated as a unit to be assembled into the overall appliance, that is, as a motor fan unit, because of various considerations relating to overall cost, facility of production, fabrication and maintenance, and as well because of the mechanical interrelation of the fan system and motor system wherein dynamic balance of rotating parts is required.

Because of the heat generated under the general and normal operating conditions, the motor must be cooled by a ventilating air stream positively moved, rather than relying upon convection or radiation.

In the prior art structures, all or part of the working air has been directed to the motor section either in reaching the air intake of, or in discharging from, the main working fan section; but various disadvantages attendant upon such systems have lead to use of a separate motor ventilating fan to move a cooling air stream separate and distinct from the working air and of structures to define a ventilating air flow path or paths through the motor structure.

Generally speaking such a separate ventilating fan has been mounted on the motor shaft at a location axially between the bearings within the main motor housing or frame, though at times outboard of one or the other end bearing, in enclosure means usually partially defined by part of the motor frame structure.

Especially where the motor fan units may be called upon to handle not only dry air, that is, carrying merely the water vapor of the ambient atmosphere, but also wet working air streams, as when a vacuum cleaner unit is operated on wet floors or shampooed carpeting, or where the unit is incorporated in an appliance usually handling dirty or wet air, for example, further problems arise. First, the use of the working air as ventilating air obviously would be unsuitable not only for the reasons which have lead to abandonment of such system even where "dry operations" solely are contemplated, but also because of the potential motor damage by moisture, unless special and costly preventative expedients are used in the motor structure.

Further, with the working air wet, even where a separate ventilating air stream is used, there still exists a definite hazard especially to the motor bearing at the fanward end of the unit, as a portion of the contained water may find its way along the shaft and through shaft-accommodating housing openings, ultimately to the bearing, unless special structural precautions are taken to provide effective sealing between the shaft and surrounding housing or shell structures to prohibit moisture or water access to the bearing. Moreover, the presence of water in the motor section from any source presents a shock hazard to a user and hence is to be prevented. Prior expedients for these purposes have generally involved structure or fabrication operations entailing additional costs of parts, and/or inconvenience or cost in assembly.

Moreover the fact that the working temperature of the air often may be rather high engenders a further problem both generally for bearing cooling adjacent the fan section and as well through the possibility of temperature-accelerated bearing deteriorating action of the moisture.

It is the general object of the present invention to provide an electric motor fan unit wherein by relatively simple and low cost expedients, there is afforded, to the fanward end bearing, protection against damage by moisture, detergents, or other substances carried into the motor fan unit by the working air.

It is a further object of the present invention to provide a motor fan unit, of relatively low cost and of simple and rugged structure (as compared to the prior art devices of similar features, performance and life ratings), wherein the motor is ventilated or cooled by an air stream other than the working air stream, but without ventilating air discharge axially along the exterior of such bearing.

Other objects and advantages will appear from the following description and the drawing wherein.

Figure 1:
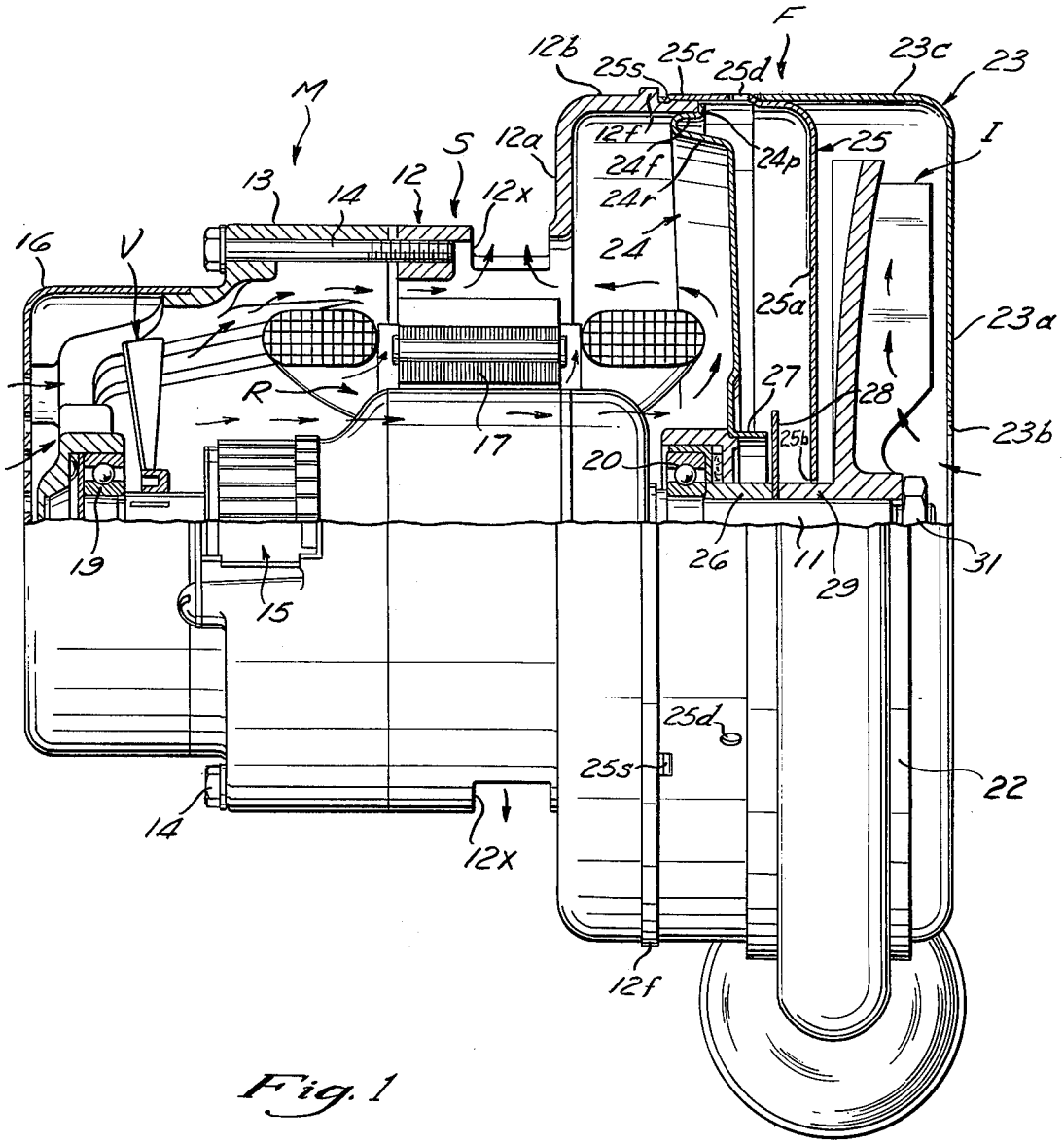
FIG. 1 represents a motor fan unit embodying the present invention, shown partially in elevation and partially in longitudinal section.

In the drawings, FIG. 1 shows a motor fan unit incorporating the invention comprising a motor section, here represented as a commutating motor and designated as a whole by the general reference letter M, including a stator structure S, and rotor R having a shaft 11 upon the commutator end of which is mounted an axial flow type ventilating fan V; and a working air fan section designated as a whole by the general reference character F, including a main or working air suction fan or impeller I mounted on the rotor shaft and enclosed in a fan shell or housing as hereinafter more fully described.

In the motor section M, the stator structure includes a first or fanward motor end bracket casting 12, to the left end of which a second end bracket casting member 13 is secured by bolts 14 passed through arcuate rim slots in 13 to provide, for the brush holder structures 15 carried on 14, an angular adjustability relative to the field core and winding assembly 17 secured in member 12; the member 13 being capped by a cup-shaped cap member 16, the apertured radial end wall of which affords a motor ventilating air inlet.

The structure thus far described in detail may be considered to be conventional.

The shaft 11 of the commutating armature is supported by appropriate bearings 19 and 20 in bearing sockets at central structures of respective integral spider portions bridging the open ends of members 13 and 12, the latter of which enlarges through radial wall 12a into an integral cylindrical rim portion 12b supporting the fan section housing shell member 23 and partition members 24 and 25 as hereinafter described.

As evident in the drawing, the left end bracket member 13 provides an open structure permitting cooling air entering the motor section at cap 16 to pass both around the bearing socket supporting bridge portion of 13, and around the brushes and commutator, and thence to flow lengthwise both between the wound field structure and the rotor or armature on the one hand and on the other, as permitted by longitudinal passages formed by clearances arising by the external shape of the field, particularly in its core or lamination stack, externally between the field structure and the enclosing motor frame housing formed by members 12 and 13; ultimately to discharge through outlet slots 12*x* in member 12; a portion of the cooling air passing between armature and field stack to the fanward bearing region, then turning to pass back to outlets 12x.

At the fan section, a main fan shell 23 is a drawn sheet metal cup-shaped member having a generally flat disk-like radial outer end wall 23*a* centrally apertured to provide an axial vacuum intake air inlet 23*b*. Member 23 includes a generally cylindrical wall 23*c* with one end rounding into 23*a* and the other open end mounted on the exteriorly cylindrical rim portion 12*b* of motor end bracket 12, by being telescoped in a press fit upon the somewhat necked-down right end of a cylindrical wall portion 25*c* providing effectively a continuation of wall 23*c* in a similar drawn sheet metal cup-shaped partition member 25 of which radial end wall 25*a* forms an intermediate wall in the housing.

Ventilating and working air paths are indicated by the unnumbered successive arrows in the drawings.

The innermost wall or partition member 24, which with member 25 defines the inner isolating or disk chamber, takes the form of a centrally apertured slightly conical disk 24, having an axially inwardly offset rim portion 24*r* of narrow U-shaped cross section providing a nearly cylindrical flange 24*f* pressed within the rim 12*b*, to the extent limited by stop lip 24*p*. The central portion is supported by fitting on a circumferential rabbet on the end of the bearing socket portion outboard of the spider arm or bridging structure.

Thus member 24 simultaneously serves as an end closure for the motor frame and for the inner end of the fan section.

About the central aperture of the sheet metal member 24 thus supported on the external rabbet, an integral drawn cylindrical bearing shield or short tubular guard flange 27 directed outwardly oppositely to flange 24*p*, projects well beyond the outboard end of the bearing socket or central structure of member 12 toward a flat slinger 28, with which it has a close axial running clearance within normal rotor shift tolerance. With further the disk 28 centrally disposed in the disk chamber formed between 24 and 25, and a plurality of spaced vent apertures 25*d*, the possibility that any portion of moisture carried into the condensing in the impeller chamber will find its way along shaft-surrounding structure into the slinger chamber is minimized by wall 25*a*; and any liquid passing wall 25*a* is obstructed by disk 28 from reaching the bearing socket, both statically and by centrifugal slinging action, whence it may vent, drain or exhaust through apertures 25*d*.

Figure 2:
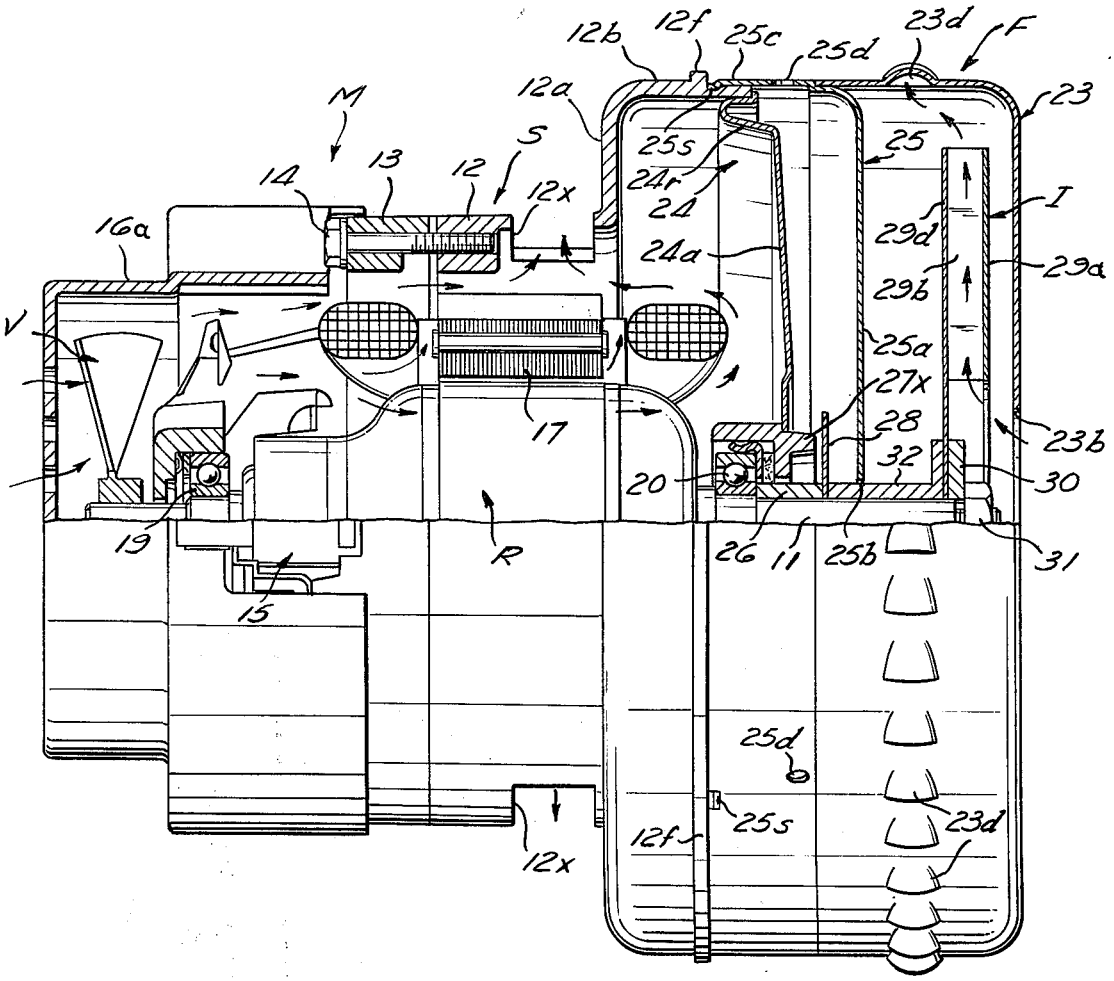
FIG. 2 is a fragmentary longitudinal sectional view indicating a variation of FIG. 1.
Figure 3:
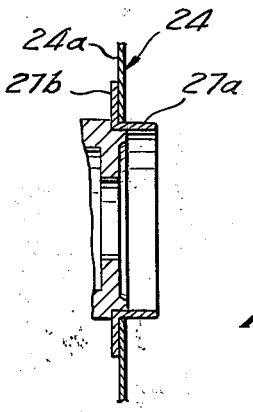
FIG. 3 is a fragmentary view partially in elevation and partially in longitudinal section of a motor fan unit modification embodying the invention.

FIG. 2 shows an alternate way of providing the short tubular bearing guarding flange and thereby simplifying production of member 24, by using a simple punched or sheared central aperture in which is inserted a radially flanged grommet-like element, or a short headed sleeve, to provide a projecting cylindrical flange 27*a* extending through the aperture, whereof the radial flange 27*b* is spot welded to the back of the disk 24. Also as in FIG. 2, the tubular bearing guard flange may be provided as an integral more or less cylindrical extension 27*x* from the outboard end of the bearing socket, in the central structure of motor end frame member 12.

The member 25 at 25*c* may be either merely press fitted onto 12b up against the integral circumferential stop rib 12*f* or further secured by a local staking as at 25*s*, into an underlying rim groove.

Again the flat radial wall 25*a* has a central opening 25*b* having a close running clearance with shaft-surrounding spacer means extending into the chamber for impeller I. The fan shell or impeller housing thus defined by members 23 and 25 is provided with discharge outlet means on its circumference, here a bolted-on attachment 22 providing a semi-scroll type tangential outlet as here shown extending partially circumferentially about wall 23*c* in coincidence with a wall slot, axially inwardly offset from alignment with impeller I, for discharge of air from the impeller chamber.

On the portion of shaft 11 projecting to the right through the bearing 20 into the fan section housing, a spacer sleeve 26 thrusting endwise against the inner bearing race at 20, in turn axially located by engagement with a shaft shoulder, supports a small flat centrally apertured slinger disk 28 clamped thereagainst by the tubular hub 29 of the main fan or working air centrifugal impeller I, in turn clamped by a clamping nut 31 threaded onto the extreme shaft end; the tubular hub being extended through 25*a* as spacing means.

The impellers I (in FIGS. 1 and 2) are, per se, of generally conventional form and structure, as, for example, in FIG. 1 an integrally die cast part; or in FIG. 2 made from sheet metal, comprising a centrally apertured body disk 29*d*, a second annular disk 29*a* defining at its central opening the impeller air intake, to which the working or cleaning air flows through the housing inlet 23*b* and a series of appropriately shaped vanes or blades 29*b* with opposite end edges secured to 29*d* and 29.

In FIG. 2, variants in ventilating impeller and main impeller clamping and discharge arrangements appear, as well as the previously noted variations in the bearing shielding flange and in the impeller I. In the fan chamber, the sheet metal body disk 29*d* is clamped against a spacer sleeve 32 by a washer 30 and nut 31 threaded onto the outboard shaft end; and again there is generally preferred, though not always necessary, a close running clearance between spacer 32 and the surrounding central aperture edge of wall 25*a*.

Here the impeller I is axially located away from the wall 25*a* toward the end wall 23*a*; and as the working air discharge means, there appears a circumferential series of louver-like outlet apertures 23*d* located in axial sense between the plane of wall 25*a* and the inner end plane of impeller I.

In this modification, the ventilating fan impeller V is disposed axially outboard of the commutator end bracket in the distinct ventilating fan chamber defined between the inlet end cup member 16*a* and 13.

With this invention as described it is apparent that the essential motor components are all included as a basic sub-assembly in the motor section, and that no special and expensive bearing seal components must be included among the motor section components.

Particularly noteworthy, in the event moisture is carried by the main working air stream entering at 23*b* during operation of the fan unit, there is no opportunity for such air to bring entrained water droplets or even warm moist air, often occuring with high humidity and temperature, anywhere near the fanward bearing region of the motor section, since here the disk chamber represents a thermally insulating and spatially or mechanically isolating structure with respect to the bearing, thus screening the motor end, bearing and innermost wall or partition 24*a* not only from entrained water but also from the moist warm air stream.

These arrangements obviously may be utilized in multi-stage fan units, for example, in a two-stage unit where aperture 23*b* is the second stage inlet, with stationary vanes on the right face of wall 23*a;* and with another cup-shaped member, similar to 25, pressed onto the end of 23 in the manner of 23 on 25, to enclose a first stage impeller, like to and similarly spaced by a sleeve from I and clamped on a longer shaft extension. Though impellers, partition and housing shell means are described and shown as metal structures, of course, molded plastic may be used for one or another of these; for example, a molded piece integrally providing cylindrical portions 23*c*, 25*c* and mid-wall 25*a*, with wall 23*a* then applied as a plastic or metal disk.

We claim:

1. In an electric motor fan unit, including an electric motor section having motor frame structure, supporting and enclosing rotor and stator structure, a ventilating fan on the rotor shaft, with motor ventilating air passages defined therethrough between motor frame portions open near one end and at the other end respectively for discharge and intake of ventilating air, said frame structure at said one end including a motor end bracket member having a central structure providing a socket with a bearing therein for the rotor shaft extending therethrough and having an end rim portion, and said unit further including a fan section having therein a main working air impeller clamped outboard on a shaft portion extending through said bearing and a fan housing structure including housing shell means providing an outer end wall centrally apertured to form an axial working air inlet to said main impeller and a further wall circumferentially surrounding the said main impeller, said housing shell means having therein main air outlet means and having an open end supported on said end rim portion, that improvement comprising:

partition means mounted to said end bracket member and forming an inmost end wall and an intermediate wall of said housing structure, said inmost end wall centrally apertured and fitted to an outboard portion of said central structure and providing an end closure for the motor frame structure, said intermediate wall having a central aperture with said shaft extended therethrough and defining with said outer and inmost end walls respectively an outer, main impeller chamber and an inner chamber;

a centrifugal slinger disk secured on said shaft in said inner chamber;

said inner chamber as a slinger chamber having vent openings in a circumferential wall portion thereof; and bearing shielding tubular flange means in coaxially spaced relation to the extending shaft portion, and projecting from said central structure, beyond the centrally apertured portion of the inmost end wall, and into close running end clearance with said slinger disk;

whereby water and other material entrained in working air entering the impeller chamber is inhibited from entering the inner chamber, and any such material entering the inner chamber along the shaft structure is prevented from access to the bearing by the cooperating bearing shielding flange and slinger disk, and the region of the motor section including said bearing is thermally insulated by said inner chamber from warm humid working air in the outer chamber.

2. An electric motor fan unit improvement as described in claim 1, with said inmost wall provided by a disk-like member having an apertured center supported on said central structure, and having an outer periphery engaged with said end rim portion.

3. An electric motor fan unit improvement as described in claim 2, with the intermediate wall being provided by a second member having a short cylindrical wall portion provided with said vent openings and mounted on the said rim portion and a generally radial centrally apertured wall portion as said intermediate wall, and said housing shell having its open end secured to the cylindrical wall portion of the last said member and thereby supported on said end rim portion.

4. An electric motor fan improvement as described in claim 2, wherein the said disk-like member forming the inmost wall is fabricated with an integral cylindrical flange about its central aperture thereby to provide said bearing shielding flange means.

5. An electric motor fan improvement as described in claim 2, with said bearing shielding flange means being provided by a short sleeve member projecting through the central aperture and having a radial end flange secured to said disk-like member.

6. An electric motor fan improvement as described in claim 1, with said bearing shielding flange means being provided by an integral outboard flange extension of bearing socket structure of said motor end bracket member.

7. An electric motor fan unit improvement as described in claim 1, with said housing shell means including a cylindrical wall portion as said further wall and said main air outlet means comprising a circumferential series of spaced air outlet apertures, adjacent said intermediate wall, in said cylindrical wall portion, and said main impeller being spaced axially outwardly from the intermediate wall beyond the locus of said series.

8. An electric motor fan unit improvement as described in claim 1, with said housing shell means including a cylindrical wall portion as said further wall and said main air outlet means comprising an air outlet slot extending in a circumferential direction partially about said cylindrical wall portion and a semi-scroll attachment over said outlet slot affording a generally tangential air outlet structure; and said main impeller being spaced axially outwardly from the intermediate wall beyond the locus of said outlet slot.

9. An electric motor fan unit improvement as described in claim 1, wherein a spacer sleeve on said shaft, with one end abutting a part of said bearing which is axially fixed on and rotating with said shaft, has its other end supporting said slinger disk;

said main impeller has a hub structure received on the shaft and including a hub extension as spacer means extending through the central aperture of the intermediate wall to bear against said disk; and clamping nut means threaded onto the outboard shaft end applies clamping force to said impeller and said disk.

10. An electric motor fan unit improvement as described in claim 1, wherein a spacer sleeve on said shaft, with one end abutting a part of said bearing which is axially fixed on and rotating with said shaft, has its other end supporting said slinger disk;

said main impeller comprises a sheet metal structure including a body disk centrally apertured for reception on said shaft, an annular disk disposed toward the working air inlet in said outer wall as the impeller air intake, and a series of spaced impeller vanes connecting the body and annular disks;

a second spacer sleeve between said slinger disk and said body disk of the main impeller locates the latter in the said outer chamber; and clamping nut means threaded onto the outboard shaft end clamps the impeller against the second spacer sleeve; the aperture of said intermediate wall having a close running radial clearance with the second said spacer sleeve extending therethrough.

11. An electric motor fan unit improvement as described in claim 1, with said main air outlet means offset away from the periphery of the main impeller toward said intermediate wall, and said slinger disk having a smaller diameter than said main impeller.

12. An electric motor fan unit improvement as described in claim 1, with the said partition means provided by a cup-shaped member and a disk-like member;

said cup-shaped member having a short cylindrical wall portion provided with said vent openings and secured on the said rim portion and a generally radial, centrally apertured wall portion as said intermediate wall;

said disk-like member being centrally apertured as said inmost end wall and having a circumferential flange of narrow U-shaped cross section press fitted in said rim portion;

said housing shell means including a cup-shaped member having its open end fitted on the cylindrical wall portion of the first said cup-shaped member and thereby supported on said rim portion;

said main air outlet means comprises a circumferential series of spaced air outlet apertures adjacent said intermediate wall in a cylindrical wall portion of said housing shell; and said main impeller is spaced axially outwardly from the intermediate wall beyond the locus of said series.

13. An electric motor fan unit improvement as described in claim 1, with the said partition means provided by a cup-shaped member and a disk-like member;

said cup-shaped member having a short cylindrical wall portion provided with said vent openings and secured on the said rim portion and a generally radial, centrally apertured wall portion as said intermediate wall;

said disk-like member being centrally apertured as said inmost end wall and having a circumferential flange of narrow U-shaped cross section press fitted to said rim portion;

said housing shell means including a cup-shaped member with a cylindrical wall portion having its open end fitted on the cylindrical wall portion of the first said cup-shaped member and thereby supported on said rim portion;

said main air outlet means comprises a circumferential series of spaced air outlet apertures adjacent said intermediate wall in a cylindrical wall portion of said housing shell means;

said main impeller is spaced axially outwardly from the intermediate wall beyond the locus of said series; and wherein a spacer sleeve on said shaft with one end abutting a part of said bearing, which is axially fixed on and rotating with said shaft, has its other end supporting said slinger disk;

said main impeller comprises a sheet metal structure including a body disk centrally apertured for reception on said shaft, an annular disk disposed toward the working air inlet in said outer wall as the impeller air intake, and a series of spaced impeller vanes connecting the body and annular disks;

a second spacer sleeve between said slinger disk and said body disk of the main impeller locates the latter in the said outer chamber; and clamping nut means threaded onto the outboard shaft end clamps the impeller against the second spacer sleeve;

the aperture of said intermediate wall having a running radial clearance with the second said spacer sleeve extending therethrough.

14. An electric motor fan unit improvement as described in claim 13, with said bearing shielding flange means provided by an integral tubular flange extension of, and at the bearing socket region of, said central structure of said motor end bracket member.

* * * * *